US011396182B2

(12) United States Patent
Kamon

(10) Patent No.: US 11,396,182 B2
(45) Date of Patent: Jul. 26, 2022

(54) PRINTING METHOD AND PRINTING APPARATUS

(71) Applicant: SCREEN HOLDINGS CO., LTD., Kyoto (JP)

(72) Inventor: Hiroaki Kamon, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/180,123

(22) Filed: Feb. 19, 2021

(65) Prior Publication Data

US 2021/0291534 A1 Sep. 23, 2021

(30) Foreign Application Priority Data

Mar. 23, 2020 (JP) ..... JP2020-051337

(51) Int. Cl.
*B41J 2/165* (2006.01)

(52) U.S. Cl.
CPC .. *B41J 2/16526* (2013.01); *B41J 2002/16529* (2013.01)

(58) Field of Classification Search
CPC ..... B41J 2/16526; B41J 2002/16529
See application file for complete search history.

(56) References Cited

U.S. PATENT DOCUMENTS

2006/0191806 A1* 8/2006 Takata ..... B41J 2/17533 206/223
2017/0203570 A1 7/2017 Katoh et al.

FOREIGN PATENT DOCUMENTS

| | | | |
|---|---|---|---|
| EP | 3 281 794 | A1 | 2/2018 |
| JP | 2009-234656 | A | 10/2009 |
| JP | 2014-184597 | A | 10/2014 |
| JP | 2014184597 | A * | 10/2014 |
| JP | 2018-051826 | A | 4/2018 |
| JP | 2019-119609 | A | 7/2019 |
| JP | 2020-001819 | A | 1/2020 |
| WO | 2019/131843 | A1 | 7/2019 |
| WO | 2020/250772 | A1 | 12/2020 |
| WO | WO-2020250772 | A1 * | 12/2020 |

OTHER PUBLICATIONS

Extended European Search Report issued in corresponding European Patent Application No. 21160012.7-1017, dated Aug. 13, 2021.

* cited by examiner

*Primary Examiner* — Justin Seo

(74) *Attorney, Agent, or Firm* — McDermott Will & Emery LLP

(57) ABSTRACT

In a printing method, is obtained position information of an invisible region invisible from outside, out of the printing surface of the packaging base material. Then a flushing process in which ink is ejected the ink toward the invisible region from the nozzle based on the position information is performed. Therefore, printing for packaging pouch can be satisfactorily performed on the packaging base material without impairing the design quality of the packaging pouch manufactured by applying the bag making process to the packaging base material.

3 Claims, 4 Drawing Sheets

PRINTING METHOD AND PRINTING APPARATUS

CROSS REFERENCE TO RELATED APPLICATION

The disclosure of Japanese Patent Application No. 2020-051337 filed on Mar. 23, 2020 including specification, drawings and claims is incorporated herein by reference in its entirety.

BACKGROUND OF THE INVENTION

1. Field of the Invention

This invention relates to a printing method and a printing apparatus for printing by ejecting ink from a nozzle to a printing surface of a packaging base material.

2. Description of the Related Art

A printing apparatus is known which prints an image by ejecting water-based or oil-based ink from a head part to a printing surface of a base material by an ink-jet method while conveying the base material in the form of an elongated strip in a longitudinal direction (see JP 2019-119609A). In this printing apparatus, if the ink is not ejected from the head part for a certain time or more, an ink viscosity near an ink eject port increases. This increase in viscosity may cause the deterioration of flying properties of the ink from the nozzle. To avoid this, it has been proposed to perform line flushing to a discard area of the base material or star flushing to a pictorial pattern part of the base material.

SUMMARY OF THE INVENTION

However, in a packaging industry for sweets packaging materials, a printing area is continuous along a longitudinal direction and no discard area exists at all. Further, a bag making process is performed by supplying a base material having desired images printed thereon by a printing apparatus to a bag making apparatus. If line flushing is performed in the printing apparatus without considering the appearance of a final product after the bag making process, i.e. a packaging pouch (or bag), a linear eject pattern appears in a part of the packaging pouch visible from a consumer to impair the design quality of the packaging pouch. Thus, a flushing process taking into account a state after the bag making process is desired in a printing technique for printing by ejecting ink to a printing surface of a packaging base material from a nozzle while conveying the packaging base material in the form of an elongated strip before the bag making process in a longitudinal direction, but such a technique does not exist.

This invention was developed in view of the above problem and aims to provide a printing technique capable of satisfactorily printing for packaging pouch on a packaging base material without impairing the design quality of a packaging pouch manufactured by applying a bag making process to the packaging base material.

One aspect of the invention is a printing method. The method comprises: (a) printing by ejecting ink to a printing surface of a packaging base material from a nozzle while conveying the packaging base material in the form of an elongated strip before a bag making process in a longitudinal direction; (b) obtaining position information of an invisible region invisible from outside, out of the printing surface of the packaging base material; and (c) performing a flushing process by ejecting the ink toward the invisible region from the nozzle based on the position information.

Other aspect of the invention is a printing apparatus. The apparatus comprises: a conveyor that conveys a packaging base material in the form of an elongated strip before a bag making process in a longitudinal direction; a head part that prints by ejecting ink from a nozzle to a printing surface of the packaging base material being conveyed by the conveyor; a position information acquirer that obtains position information of an invisible region invisible from outside after the bag making process, out of the printing surface of the packaging base material, and a flushing controller that performs a flushing process by ejecting the ink from the nozzle toward the invisible region based on the position information.

Note that the "invisible region invisible from outside after the back making process" means not only a region invisible by being not exposed in the packaging pouch manufactured by the bag making process as shown in FIGS. 4A, 4B and 5 to be described later, but also a region invisible by being hidden when a product packaged using the packaging pouch is on display.

According to the invention, since the flushing process is performed by ejecting the ink from the nozzle toward the invisible region invisible from outside after the bag making process, out of the printing surface of the packaging base material, printing for packaging pouch can be satisfactorily performed on the packaging base material without impairing the design quality of the packaging pouch manufactured by applying the bag making process to the packaging base material.

All of a plurality of constituent elements of each aspect of the invention described above are not essential and some of the plurality of constituent elements can be appropriately changed, deleted, replaced by other new constituent elements or have limited contents partially deleted in order to solve some or all of the aforementioned problems or to achieve some or all of effects described in this specification. Further, some or all of technical features included in one aspect of the invention described above can be combined with some or all of technical features included in another aspect of the invention described above to obtain one independent form of the invention in order to solve some or all of the aforementioned problems or to achieve some or all of the effects described in this specification.

DESCRIPTION OF EMBODIMENTS

Figure 1:
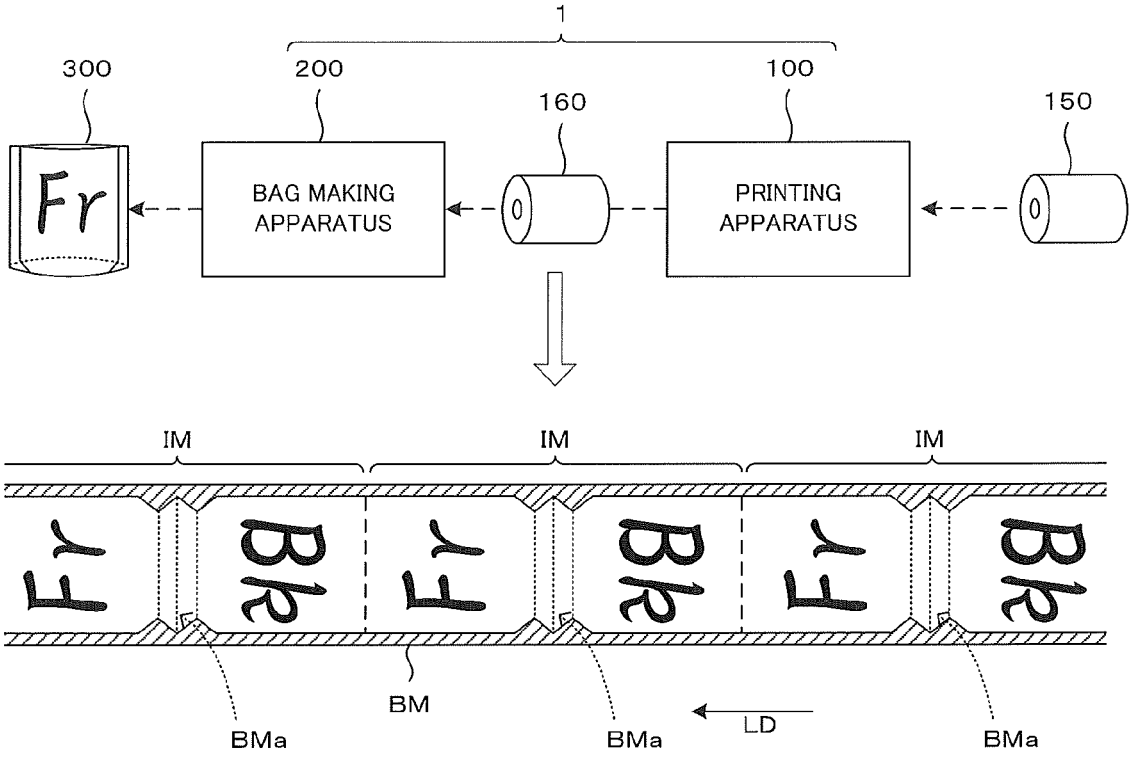
FIG. 1 is a schematic diagram showing an example of a manufacturing system for manufacturing a packaging pouch using a first embodiment of a printing apparatus according to the invention and a bag making apparatus.

FIG. 1 is a schematic diagram showing an example of a manufacturing system for manufacturing a packaging pouch using a first embodiment of a printing apparatus according to the invention and a bag making apparatus. This manufacturing system 1 includes an ink-jet type printing apparatus 100 and a bag making apparatus 200 and manufactures a so-called stand-up pouch (or bag). The stand-up pouch 300 is a self-standing pouch formed by folding a base material BM for packaging having desired images printed by the printing apparatus 100 into two, sealing both sides and forming a bottom part into a ship bottom shape. Note that soft packaging materials including films such as PET (polyethylene terephthalate), nylon, OPP (oriented polypropylene) and CPP (cast polypropylene), laminates of these, cellophanes and the like can be used as the base material BM.

The printing apparatus 100 pays out the transparent base material BM from a roll 150 formed by winding the transparent base material in the form of an elongated strip and prints printing images IM ("Fr" on a front surface side" and "Bk" on a back surface side" in FIG. 1) and mark images (not shown) for bag making process while conveying the base material BM in a longitudinal direction. The printed base material BM is wound into a roll 160. This roll 160 is conveyed from the printing apparatus 100 to the bag making apparatus 200. The bag making apparatus 200 having received the roll 160 pays out the base material BM from the roll 160 and applies a bag making process, whereby the stand-up pouch 300 is manufactured.

In this manufacturing system 1, the printing images IM for stand-up pouch to be printed by the printing apparatus 100 to manufacture one stand-up pouch 300 are formed one after another in a longitudinal direction LD of the base material BM as shown in a lowermost stage of FIG. 1. That is, no discard area exists in the base material BM as described above. On the other hand, a flushing process needs to be regularly performed for satisfactory printing by an ink-jet method. Accordingly, in the printing apparatus 100 according to this embodiment, focusing that a part of the base material BM corresponding to a bottom part of the stand-up pouch 300 is an area invisible from a consumer when the consumer purchases a product packed into the stand-up pouch 300, this part is set as an invisible region BMa and the flushing process is performed in this invisible region BMa. The configuration and operation of the printing apparatus 100 are described in detail below.

Figure 2:
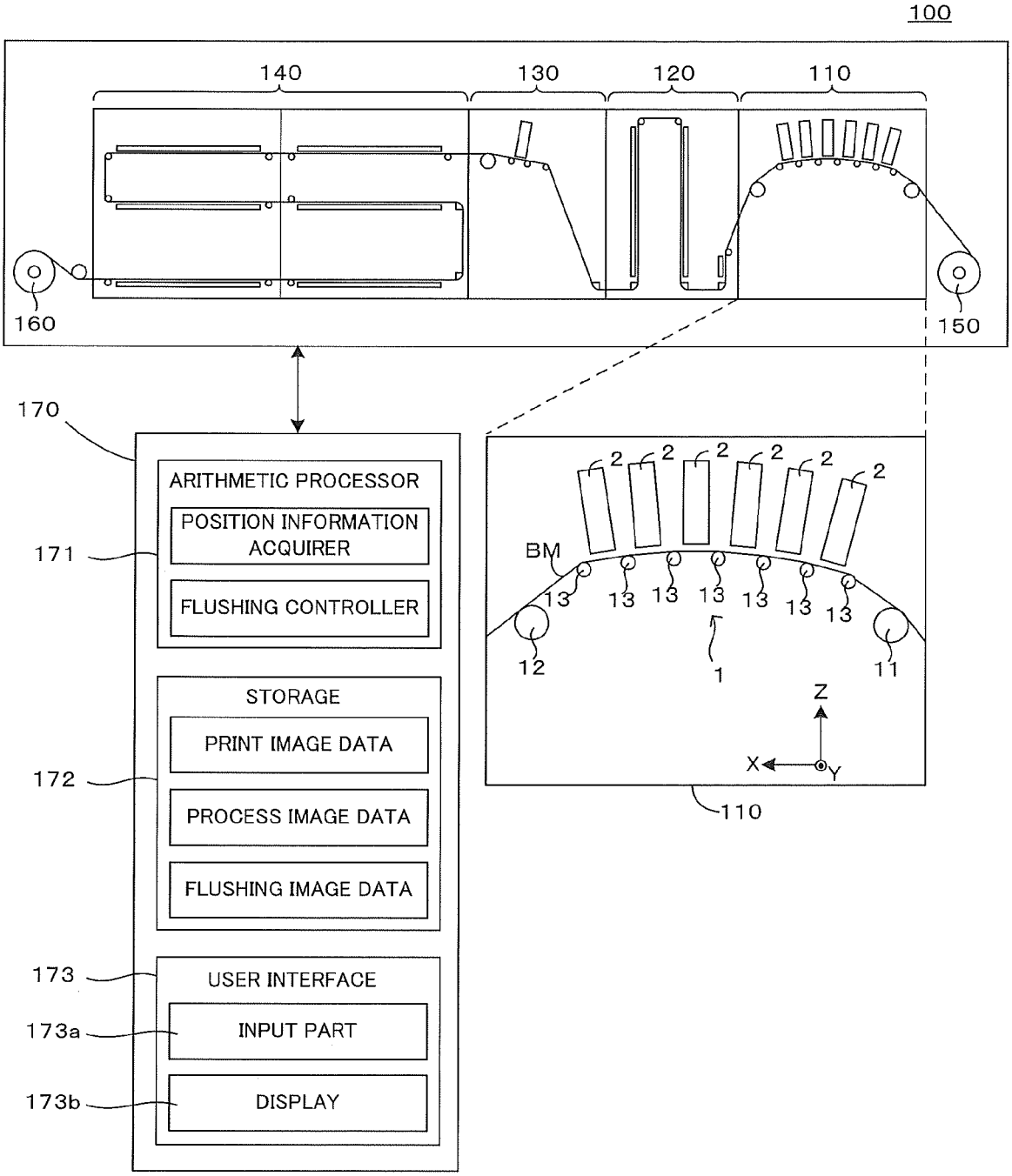
FIG. 2 is a diagram schematically showing the first embodiment of the printing apparatus according to the invention.

FIG. 2 is a diagram schematically showing the first embodiment of the printing apparatus according to the invention and is an example of the printing apparatus 100 installable in the above manufacturing system 1. This printing apparatus 100 is an apparatus for printing by ejecting ink to a printing surface of the base material BM while conveying the base material BM in the form of an elongated strip in a roll-to-roll method. Note that a width direction of the base material BM is referred to as a "Y direction" and a horizontal direction orthogonal to the Y direction is referred to as an "X direction" to clarify an arrangement relationship of each component of the apparatus in each of the following figures. Further, a vertical direction is referred to as a "Z direction".

In the printing apparatus 100, as shown in FIG. 2, a front-stage printer 110, a front-stage dryer 120, a rear-stage printer 130 and a rear-stage dryer 140 are arrayed in this order in the horizontal direction X at the same height. Further, in this printing apparatus 100, the packaging base material BM is conveyed in a roll-to-roll manner from the roll 150 to the roll 160. The printing apparatus 100 dries the base material BM printed in the front-stage printer 110 in the front-stage dryer 120 and further dries the base material BM printed in the rear-stage printer 130 in the rear-stage dryer 140.

The front-stage printer 110 includes a conveyor 10 for conveying the base material BM from right to left as shown in a partial enlarged view in FIG. 2. The conveyor 10 includes a carry-in roller 11 for carrying the base material BM paid out from the roll 150 into a housing of the front-stage printer 110 and a carry-out roller 12 for carrying out the base material BM toward the front-stage dryer 120. The carry-in roller 11 and the carry-out roller 12 drive the base material BM while being held in contact with the back surface of the base material BM from below. Further, a plurality of backup rollers 13 are provided between the carry-in roller 11 and the carry-out roller 13. Each of these backup rollers 13 supports the base material BM from below by being held in contact with the back surface of the base material BM from below.

Out of the plurality of backup rollers 13, the most upstream backup roller 13 and the most downstream backup roller 13 in a conveying direction are at the same height position, and front-stage printing is performed between these rollers. That is, a path between these two backup rollers 13, 13 is set as a front-stage printing path. The plurality of backup rollers 13 are arranged at certain intervals along the front-stage printing path. These plurality of backup rollers 13 are arranged at a higher position toward a central part of the front-stage printing path and support the base material BM. As a result, the conveying direction of the base material BM is not constant. The conveying direction of the base material BM is obliquely upward with respect to the horizontal direction X in a first half of the front-stage printing path, substantially parallel to the horizontal direction X in the central part and obliquely downward with respect to the horizontal direction X in a second half. That is, the conveyor 10 can continuously convey the base material BM in the form of an elongated strip by an upward projecting substantially arcuate conveyance path.

A plurality of head parts 2 for printing by ejecting the ink to the printing surface of the base material BM being conveyed in this way are arranged along the printing path. More specifically, the head part 2 is arranged at a position above a part of the base material BM moving between two backup rollers 13 adjacent to each other. Each head part 2 ejects the ink to the printing surface of the base material BM having both sides supported by two backup rollers 13 in an ink-jet method. In an example shown here, six head parts 2 including four head parts 2 for ejecting ink of four process colors (yellow, magenta, cyan, black) and two head parts 2 for ejecting ink of two specific colors (orange, violet, green, etc.) are provided. Each head part 2 has a nozzle surface for ejecting the ink on a lower surface, and ejects the ink from this nozzle surface to the printing surface of the base material BM being conveyed along the substantially arcuate conveyance path.

Further, each head part 2 ejects the ink from the nozzle surface in a so-called ink-jet method. On the other hand, if ink is not ejected from a nozzle for a certain time or more, the flying properties of the ink from the nozzle is deteriorated due to an increase in viscosity and the like. Accordingly, in this embodiment, a controller 170 controls each component of the printing apparatus 100 to perform a printing process based on a print command and perform the flushing process at a suitable timing.

The controller 170 is composed of a known CPU (Central Processing Unit) for performing a logical operation, a ROM (Read Only Memory) storing defaults and the like, a RAM (random access memory) for temporarily storing various pieces of data during the operation of the printing apparatus 100, and the like. Specifically, the controller 170 may be a dedicated device equipped with the hardware described above or may be a general-purpose processing device such as a personal computer or a work station having a control program for realizing a processing function to be described later incorporated therein, and a general-purpose computer can be used as such.

The controller 170 is functionally provided with an arithmetic processor 171, a storage 172, a user interface 173 and the like. Out of these, the storage 172 stores print image data obtained by converting data included in a print command and process image data beside the control program, and stores flushing images in advance. Further, the user interface 172 is an interface for outputting information to a user and receiving an input from the user, and includes an input part 173*a* and a display 173*b*. The input part 173*a* receives an input from the user and outputs the receive input to the arithmetic processor 171. The display 173*b* displays various pieces of information in accordance with an instruction from the arithmetic processor 171.

The arithmetic processor 171 reads the control program stored in advance in the storage 172 and controls each component of the apparatus in accordance with the control program as described in detail next with reference to FIG. 3. In this way, the arithmetic processor 171 receives a print command given from an external device, obtains position information of the invisible regions BMa based on this print command and performs the flushing process based on this position information. Specifically, the arithmetic processor 171 functions as a "position information acquirer" and a "flushing controller" of the invention.

Figure 3:
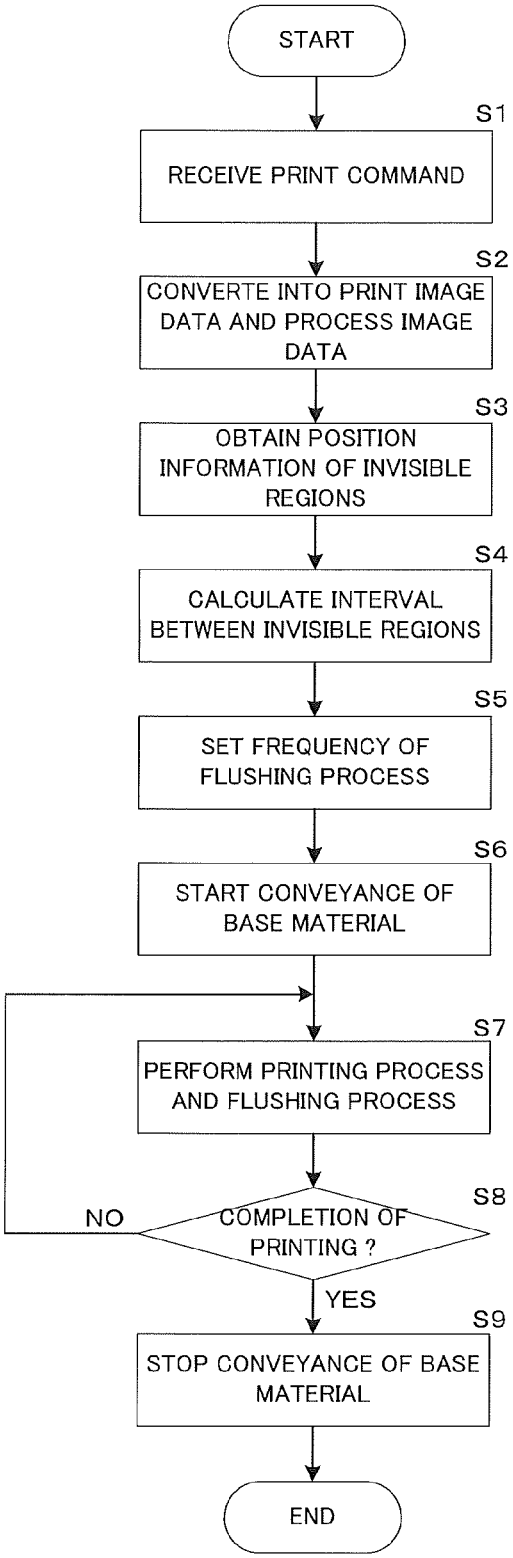
FIG. 3 is a flow chart showing a printing method performed by the printing apparatus shown in FIG. 2.

FIG. 3 is a flow chart showing a printing method performed by the printing apparatus shown in FIG. 2. The arithmetic processor 171 receives a print command from the external device (Step S1). The "print command" mentioned here includes information on images to be printed on the printing surface of the packaging base material BM such as a transparent film, i.e. information on print images for stand-up pouch (hereinafter, referred to as "print image information"), information on images for back making process (hereinafter, referred to as "process image information") and the like. The process image information means various pieces of information used when the bag making apparatus 200 manufactures the stand-up pouch 300 by applying the bag making process to the base material BM printed in response to the above print command.

The arithmetic processor 171 converts the print command into data suitable for printing by the head parts 2. Specifically, the print image information is converted into print image data and the process image information is converted into process image data, and these pieces of data are stored in the storage 172 (Step S2). Further, the arithmetic processor 171 obtains the position information of the invisible regions BMa corresponding to the bottom parts in the base material BM based on the process image data (Step S3). Since a plurality of print images (e.g. images IM each including a pair of "Fr" and "Bk" as shown in FIG. 1) for manufacturing the stand-up pouches 300 need to be printed one after another on the printing surface of the base material BM, a corresponding number of the invisible regions BMa are also included in the printing surface of the base material BM.

Accordingly, in this embodiment, the arithmetic processor 171 calculates an interval between the invisible regions BMa (Step S4) and sets a frequency of the flushing process to correspond to the calculated interval (Step S5). These steps are performed for the following reason. If the size of the stand-up pouch 300 is small, the interval of the invisible regions BMa is narrow. Since the invisible regions BMa are regions to be subjected to the flushing process as described later, the ink is excessively consumed if the flushing process is performed for each invisible region BMa. Accordingly, as the bag size becomes smaller, the frequency of the flushing process is reduced. For example, ink consumption can be suppressed by ejecting the ink from the nozzle of the head part 2 toward the invisible region BMa to perform the flushing process every time the invisible region BMa reaches a position below this head part 2 a plurality of times. Further, in this embodiment, a flushing intensity (eject amount of the ink per unit time from the nozzle) is set after evaluating an open time determined by a combination of the ink and the head part 2, i.e. a time during which a cap (not shown) is removed from the nozzle surface of the head part 2, besides the frequency of the flushing process.

If the preparation of the printing process for the print images IM and the flushing process is completed in this way, the arithmetic processor 171 controls the conveyor 10 to start the conveyance of the base material BM (Step S6). Then, the arithmetic processor 171 controls each head part 2 to perform the printing process and the flushing process in parallel (Step S7). More specifically, the print images IM are printed by ejecting the ink to the printing surface of the base material BM from each head part 2 while conveying the base material BM in the longitudinal direction (LD of FIG. 1). Further, the ink is ejected toward the invisible region BMa located below each head part 2 at the frequency set in Step S5 to perform the flushing process. The type of the flushing process may be line flushing or star flushing.

Then, when confirming the completion of the printing process and the flushing process ("YES" in Step S8), the arithmetic processor 171 stops the conveyance of the base material BM (Step S9) and finishes a series of processes.

As described above, since the flushing process is performed by ejecting the ink toward the invisible regions BMa from the nozzle in this embodiment, the print images IM for stand-up pouch can be satisfactorily printed on the base material BM without impairing the design quality of the stand-up pouches 300 manufactured by applying the bag making process to the base material BM.

Further, since the frequency of the flushing process is adjusted according to the interval of the invisible regions BMa (or the bag size), running cost can be reduced by suppressing the amount of ink consumed by the flushing process.

As described above, in this embodiment, Step S7 corresponds to examples of a "printing step" and a "flushing step" of the invention. Further, the position corresponding to the bottom part in the base material BM corresponds to an example of "position information of an invisible region" of the invention, and a step of obtaining this information (Step S3) corresponds to an example of a "position information obtaining step" of the invention. Further, Step S1 corresponds to an example of a "command receiving step". Further, the print image data and the process image data respectively correspond to examples of "print image information" and "process image information" of the invention.

Note that the invention is not limited to the above embodiment and various changes other than the aforementioned ones can be made without departing from the gist of the invention. The region invisible from the consumer by being hidden when the packaged product is on display serves as an "invisible region invisible from outside after a bag making process" of the invention in the above embodiment. Besides the above, a region invisible by being not originally exposed in a packaging pouch manufactured by the bag making process as described next is also included in the "invisible region invisible from outside after the bag making process" of the invention.

Figure 4A:
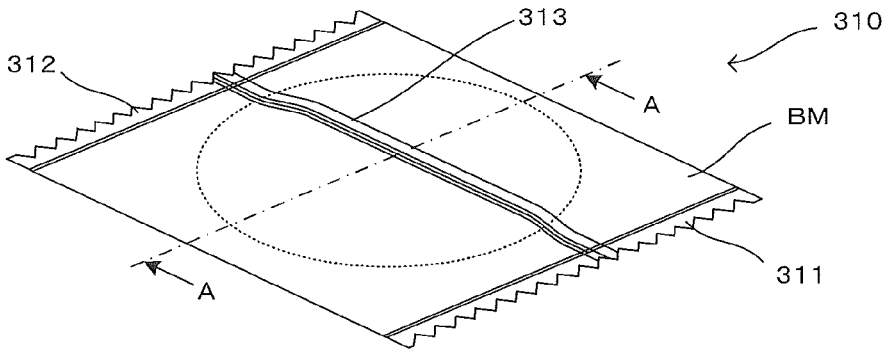
FIG. 4A is a perspective view showing an example of a preferable packaging pouch suitably applied to the printing method according to the invention.
Figure 4B:
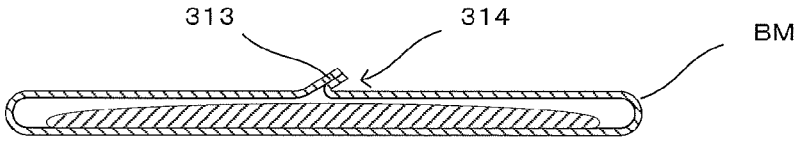
FIG. 4B is a sectional view along line A-A of the packaging pouch shown in FIG. 4A.

FIG. 4A is a perspective view showing an example of a preferable packaging pouch suitably applied to the printing method according to the invention. Further, FIG. 4B is a sectional view along line A-A of the packaging pouch shown in FIG. 4A. The packaging pouch shown in these figures is a center seal pouch 310 containing sweets such as cookies. This center seal pouch 310 is formed by bonding one base material BM in the back and bottom and provided with end welded parts 311, 312 and a back lining part 313 formed by welding end parts. Particularly, a part of the back lining part 313 folded toward a pouch side (right-lower side of FIG. 4B) and a part thereof covered by the part 314 are not exposed and are invisible from outside. Thus, a region corresponding to the folded part 314, out of the printing surface of the base material BM, may be set as an invisible region and flushing may be performed here.

Figure 5:
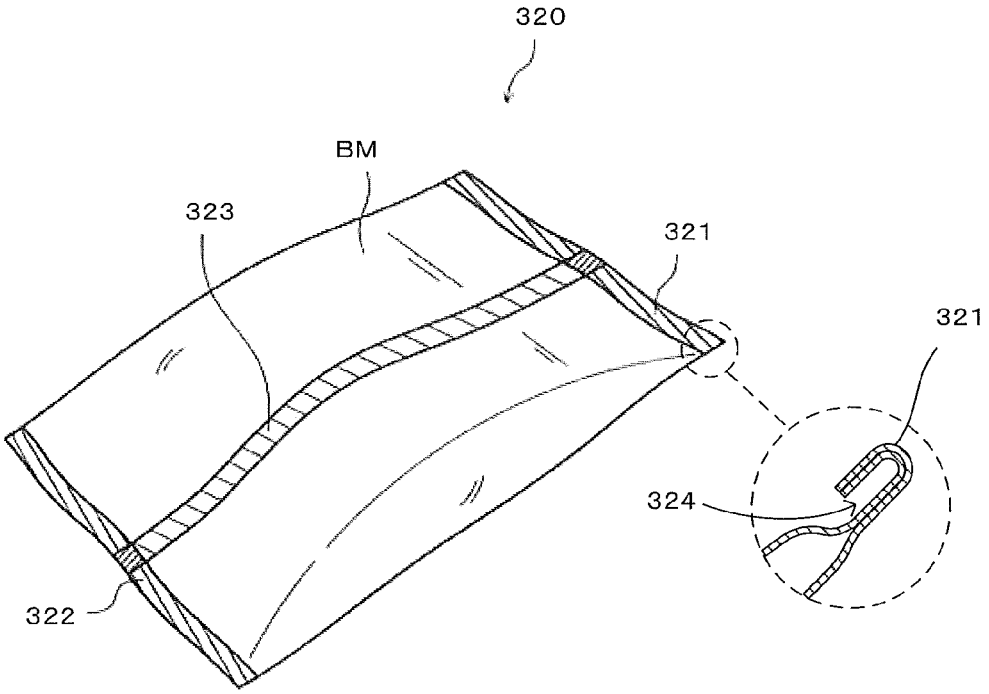
FIG. 5 is a perspective view showing another example of the preferable packaging pouch suitably applied to the printing method according to the invention.

FIG. 5 is a perspective view showing another example of the preferable packaging pouch suitably applied to the printing method according to the invention, and a self-heating packaging pouch 320 packaging a frozen food or the like. The self-heating packaging pouch 320 is the same center seal pouch as above, but is welded with end welded parts 321, 322 folded as shown in a partial enlarged view of FIG. 5 to enhance the sealability of the end welded parts 321, 322 as compared to a back lining part 323 (see, for example, JP 2020-1819A). In this case, folded parts 324 are invisible. Thus, a region corresponding to the folded part 324, out of the printing surface of the base material BM, may be set as an invisible region and flushing may be performed here.

Further, the invention can be applied also to a printing technique for printing on a base material for manufacturing, for example, stand-up zipper pouches (or bags), bottom gusset pouches (or bags) and the like besides the stand-up pouches (or bags) 300, the center seal pouches 310 and the self-heating packaging pouches (or bags) 320.

Further, although the position information of the invisible regions BMa is obtained based on the process image data (process image information) in the above embodiment, the method for obtaining the above position information is not limited to this. For example, images for bag making process, e.g. register marks, may be recorded on the base material BM in advance, and the position information of the invisible regions BMa may be obtained by detecting the images for back making process in the case of performing the printing process on the basis of the images for bag making process.

Further, bag making process information on the bag making process to be applied to the base material BM by the bag making apparatus 200, e.g. the type and bag making dimensions of the bags may be obtained and the position information may be derived from this bag making process information. Further, the position information may be received from the user via the user interface.

Further, although the bag making process is performed by supplying the roll 160 obtained by winding the base material BM printed in the printing apparatus 100 to the bag making apparatus 200 in the above embodiment, the base material BM printed in the printing apparatus 100 may be directly supplied to the bag making apparatus 200.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

This invention is generally applicable to printing techniques for printing by ejecting ink from a nozzle to a printing surface of a packaging base material.

What is claimed is:

1. A printing method, comprising:

(a) printing by ejecting ink to a printing surface of a packaging base material from a nozzle while conveying the packaging base material in the form of an elongated strip before a bag making process in a longitudinal direction;

(b) obtaining position information of an invisible region invisible from outside, out of the printing surface of the packaging base material; and (c) performing a flushing process by ejecting the ink toward the invisible region from the nozzle based on the position information, wherein the step (b) includes receiving the position information from a user via a user interface.

2. The printing method according to claim 1, wherein:

a plurality of the invisible regions are set while being spaced from each other in the longitudinal direction, and a frequency of the flushing process is changed according to an interval between the invisible regions adjacent to each other in the longitudinal direction in the flushing process.

3. A printing apparatus, comprising:

a conveyor that conveys a packaging base material in the form of an elongated strip before a bag making process in a longitudinal direction;

a head part that prints by ejecting ink from a nozzle to a printing surface of the packaging base material being conveyed by the conveyor;

a position information acquirer that obtains position information of an invisible region invisible from outside after the bag making process, out of the printing surface of the packaging base material, and a flushing controller that performs a flushing process by ejecting the ink from the nozzle toward the invisible region based on the position information, wherein the position information acquirer includes receiving the position information from a user via a user interface.

* * * * *